US006171465B1

(12) United States Patent
Compton

(10) Patent No.: US 6,171,465 B1
(45) Date of Patent: Jan. 9, 2001

(54) DESALTER

(76) Inventor: Bill E. Compton, 1315 S. Indian, Tulsa, OK (US) 74127

( * ) Notice: Under 35 U.S.C. 154(b), the term of this patent shall be extended for 0 days.

(21) Appl. No.: 09/400,673

(22) Filed: Sep. 21, 1999

(51) Int. Cl.[7] ..... C10G 33/02

(52) U.S. Cl. ..... 204/570; 204/563; 204/666; 204/660; 204/672; 210/188 W; 210/181; 210/521; 210/748; 210/801; 95/253; 95/262; 96/197; 96/198; 96/207; 96/215; 96/220

(58) Field of Search ..... 95/253, 262; 204/570, 204/563, 660, 666, 672; 196/125, 126, 127; 208/187, 251 R; 96/198, 197, 207, 215; 210/748, 801, 181, 188, 521; 422/186, 186.04

(56) References Cited

U.S. PATENT DOCUMENTS 4,919,777 * 4/1990 Bull ..... 204/188

* cited by examiner

*Primary Examiner*—Kathryn Gorgos
*Assistant Examiner*—Christopher M. Keehan

(74) *Attorney, Agent, or Firm*—Frank J. Catalano

(57) ABSTRACT

A longitudinally horizontal pressure vessel desalts a fluid mixture of oil, an emulsion of oil globules encapsulated in salt water casings, gas and/or free water. A vertical wall splits the vessel into a double length flow path extending from an inlet to separate outlets for discharging the gas, the free water and the oil. A plurality of vertical baffles at intervals between the inlet and the outlets are divided along horizontal lines into a lowermost perforated zone for passing free water, a lower central zone for blocking passage of the emulsion, an upper central perforated zone for stripping the salt water casing from the oil globules and for passing oil and an uppermost open zone for passing gas. The line dividing the lower and upper central zones of each baffle are higher than the corresponding line of each preceding baffle along the flow path extending from the inlet to the outlets. Fire tubes disposed on both sides of the wall proximate the second end of the vessel heat the fluid to approximately 120° F. Free water is removed from the vessel upstream of the fire tubes. A horizontal high voltage grid system immersed in the emulsion blocked between baffles downstream of the fire tubes facilitates breaking of the emulsion. A slot with a vertically adjustable lower perimeter in the fluid path proximate the outlets permits control of the retention time of oil in the vessel.

16 Claims, 5 Drawing Sheets

DESALTER

BACKGROUND OF THE INVENTION

This invention relates generally to desalters and more particularly concerns a vessel and method for removing water, salt and gas from oil.

The fluid produced from a typical oil well commonly includes gases and is also often tainted by salt, especially if the well has relatively low downhole pressure and is therefore susceptible to migration of salt water into the oil reservoir. The salt is typically removed from the oil by mixing fresh water with the fluid and then remove the resulting saline solution. The efficiency in removing the salt water is sometimes improved by the addition of chemicals or heat to the emulsion. An elaborate array of equipment and a generally inefficient method have evolved in the industry. As is illustrated in FIG. 1, the oil is first admitted into a separator to remove gas. It is then heated in an indirect heater to approximately 175° F. Gases are again removed from the heated oil in another separator. In many applications, globules of water which have not associated with the oil are then removed in a free water knock out. Fresh water is then introduced into and mixed with the oil, the result being a combination of residual gases, globules of oil, an emulsion of oil globules in salt water film casings and globules of free water, all substantially separable into tiers by gravity. Some liquid will be dispersed in the gas, some gas will be entrained in the oil and salt may be dispersed throughout. This combination is then purified in a first desalter and, usually, in a second desalter. In some applications, it may be necessary to use more than two desalters. The purified oil is then delivered to a storage tank. This method and the known desalters used to accomplish it have many deficiencies.

A first deficiency is that, in known desalters, the fluid flows through a horizontal cylindrical vessel having an inlet at one end and an outlet at the opposite end, so that the fluid quickly flows in a single pass through the vessel. The benefits of longer residence times are disregarded.

A second deficiency is that known desalters are liquid-fluid packed and cannot be used for separation of gas.

A third deficiency is that, in the normal flow pattern of fluid through a vessel, high velocity flow occurs only in approximately the middle forty percent of the vessel cross sectional area as can be seen in FIG. 2. Outside the high velocity flow path, approximately twenty percent of the flow vessel cross-sectional area exhibits eddy current flow. The approximately forty percent of the cross sectional area remaining at the perimeters of the vessel outside of the eddy flow zones exhibits stagnant flow. Thus, very little of the vessel is put to efficient use.

A fourth deficiency is that for known desalters it is necessary to preheat the fluid to at least 175° F. This drives off all the light ends entrained in the oil, especially gasoline, and shrinks the oil volume.

A fifth deficiency is that while 175 B.T.U.'s are required to raise the temperature of one barrel of oil 1° F., it takes 350 B.T.U.'s to raise the temperature of one barrel of water 1° F. But known desalters heat the fluid injected into them without first removing any of the free water injected into or separated by the desalter. The high temperature requirement, together with the need to raise and maintain not only the emulsion and purified oil but also the water to and at that high temperature, is a highly inefficient use of energy.

A sixth deficiency is that known desalters use vertically aligned high voltage grids in a very inefficient fashion to assist in breaking down the emulsion. In order to recover globules of purified oil from the emulsion, it is necessary to rupture or break the surface tension of the water films encapsulating the oil globules. For thinner films of water, known as tight emulsions, surface rupture is much more difficult. Therefore, known desalters immerse vertical grounded and high voltage grids in the fluid along the length of the vessel. High voltage cycled across the grids stretches the water film to a maximum at the peaks of the power sine wave. However, the vertically aligned grids are typically eighteen to twenty-four inches apart because the high quantity of water retained in the desalter would short the system if the grids were closer together. Furthermore, known desalter grid systems afford no adjustment for the different percentages of water content encountered in different emulsions. If the voltage applied to a given emulsion is too low, the water film may not be stretched sufficiently to break its surface tension. On the other hand, if the voltage applied is too high, the emulsion globules may be split into smaller emulsion globules rather than separated into oil globules and water globules. But each known desalter applies its preset spacing and voltage to all of its applications.

A seventh deficiency is that, since the grids are vertical, considerable portions of the flow path are vertical. This results in the separated water flow countering the flow of the crude oil, increasing the water settling time.

It is, therefore, an object of this invention to provide a desalter and a method of desalting oil which increases the residence time of the emulsion in the desalter. Another object of this invention is to provide a desalter and a method of desalting oil which more efficiently uses the flow area of the vessel. A further object of this invention is to provide a desalter and a method of desalting oil which uses heat more efficiently in breaking the emulsion. Yet another object of this invention is to provide a desalter and a method of desalting oil which reduces the process temperature requirements of the desalter. It is also an object of this invention to provide a desalter and a method of desalting oil which removes a substantial quantity of free water from the desalter before the application of heat to the fluid. Still another object of this invention is to provide a desalter and a method of desalting oil which increases the efficiency of the high voltage grid system of the desalter. An additional object of this invention is to provide a desalter and a method of desalting oil which eliminates much of the equipment presently used in conjunction with the desalter.

SUMMARY OF THE INVENTION

In accordance with the invention, a vessel is provided which desalts a fluid mixture of oil, an emulsion of oil globules encapsulated in salt water casings, gas and/or free water. A longitudinally horizontal pressure vessel has an inlet for admitting the fluid mixture and a plurality of outlets for separately discharging the gas, the free water and the oil. A plurality of vertical baffles are disposed at intervals between the inlet and the outlets. Each of the baffles is divided along horizontal lines into a lowermost perforated zone for passing free water, a lower central zone for blocking passage of the emulsion, an upper central perforated zone for stripping the salt water casing from the oil globules and for passing oil and an uppermost open zone for passing gas. The line dividing the lower and upper central zones of each baffle are higher than the corresponding line of each preceding baffle along the flow path extending from the inlet to the outlets. This increases the residence time of the emulsion in the vessel and increasingly purifies the oil to be recovered.

Preferably, a longitudinal vertical wall splits the vessel so that the flow path extends on one side of the wall from the inlet at one end of the vessel through a turn at the other end of the vessel and back on the other side of the wall to the outlets at the first end of the vessel. This essentially doubles the length of the flow path of the vessel, thus increasing the residence time of the emulsion in the vessel and also making more efficient use of the vessel area.

Fire tubes disposed on both sides of the wall proximate the second end of the vessel heat the fluid to approximately 100° to 120° F. The fire tubes are preferably disposed between two of the baffles along the flow path and these two baffles are of heat retaining material. An outlet disposed at a point along the flow path upstream of fire tubes permits removal of free water from the vessel. Since the emulsion has longer residence time in the vessel, the operating temperature can be considerably lower than in known desalters. It may not be necessary, in many instances, to use the fire tubes at all, since the oil may already be at a temperature greater than 100° F. when it is introduced into the desalter. Since the free water is removed before heating the fluid, far less energy is required. Another advantage of this arrangement is that the juxtaposed fire tube portions of the forward and back paths of the vessel reuse any heat transferred in the other fire tube zone.

It is preferred that an upper horizontal grounded grid and a lower horizontal high voltage grid connected to an alternating current source be disposed between two of the baffles downstream of the fire tubes. The grids are spaced for immersion in the emulsion blocked between the two baffles downstream of the fire tubes. The horizonal grids offer a greater emulsion breaking zone than the vertical grids of known desalters and also facilitate change of their spacing to suit the application. Furthermore, since free water has been removed upstream of the grids, they can be more closely spaced, increasing the efficiency of this part of the system. It is also preferred that a slot with a vertically adjustable lower perimeter be disposed in the fluid path proximate the outlets to further facilitate control of the retention time of oil in the vessel.

In practicing the method of removing salt from the fluid, fresh water and emulsion breaking chemical are injected into the fluid. The injected water and chemical are mixed with the fluid to dissolve the salt. The mixed water, chemical and fluid are admitted into a vessel longitudinally vertically split into a forward and back continuous passage divided into sections by spaced apart vertical baffles. The gas, oil, emulsion and water are allowed to substantially separate by gravity into tiers. The gas is passed through open upper portions of the baffles to scrub liquids by gravity fall out. The oil is passed through perforations in the baffles to detrain gas entrained in the oil. The flow of emulsion is blocked with increasingly higher unperforated portions of the baffles to increase the retention time of the emulsion in the vessel and to allow breaking of the emulsion. Substantially all the free water is ejected from the vessel upstream of heating and high voltage grid sections of the vessel. The gas, oil, emulsion and remaining free water are heated to a temperature of approximately 100° F. to 120° F. if not already at that temperature. The heated emulsion is then passed between the horizontal high voltage grids to further break down the emulsion. The resulting gas, oil and water are collected in separate retrieval systems.

As a result of this process, gravity separation of coalesced water from the crude oil is enhanced. The specially designed baffles assist in the coalescence of the emulsion. The combination of larger residence time and greater mechanical coalescence reduces the emulsified water content transferred to the high voltage grid chamber, thus allowing closer grid spacing without short circuiting and increased electrostatic coalescence. The truly horizontal flow facilitates gravity separation of the coalesced water from the crude oil and reduces the water settling time. Furthermore, the moving oil-water interface minimizes the accumulation of oil-water interfacial sludge and eliminates the need for a sludge collection system. And, looking at FIG. 1, the two separators, the indirect heater, the free water knockout and the additional desalters used with known desalters are no longer required.

BRIEF DESCRIPTION OF THE DRAWINGS

Other objects and advantages of the invention will become apparent upon reading the following detailed description and upon reference to the drawings in which.

While the invention will be described in connection with a preferred embodiment and method, it will be understood that it is not intended to limit the invention to that embodiment and method. On the contrary, it is intended to cover all alternatives, modifications and equivalents as may be included within the spirit and scope of the invention as defined by the appended claims.

DETAILED DESCRIPTION

Figure 1:
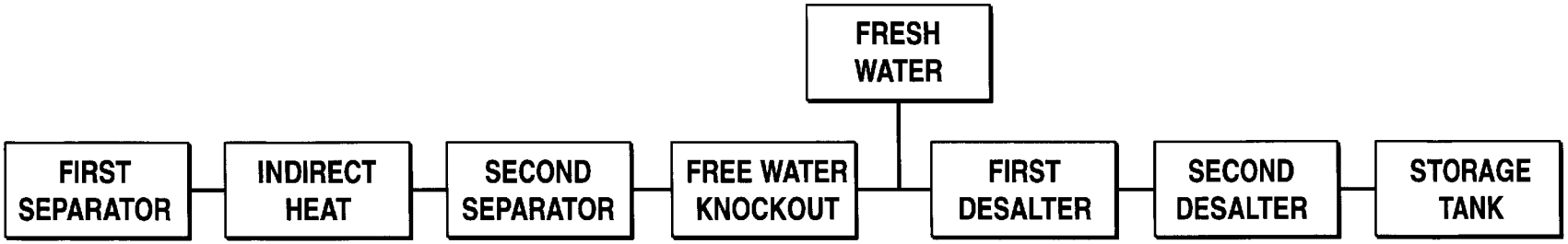
Fig. 1 ( PRIOR ART )
FIG. 1 is a block diagram illustrating the prior art desalting process.
Figure 2:
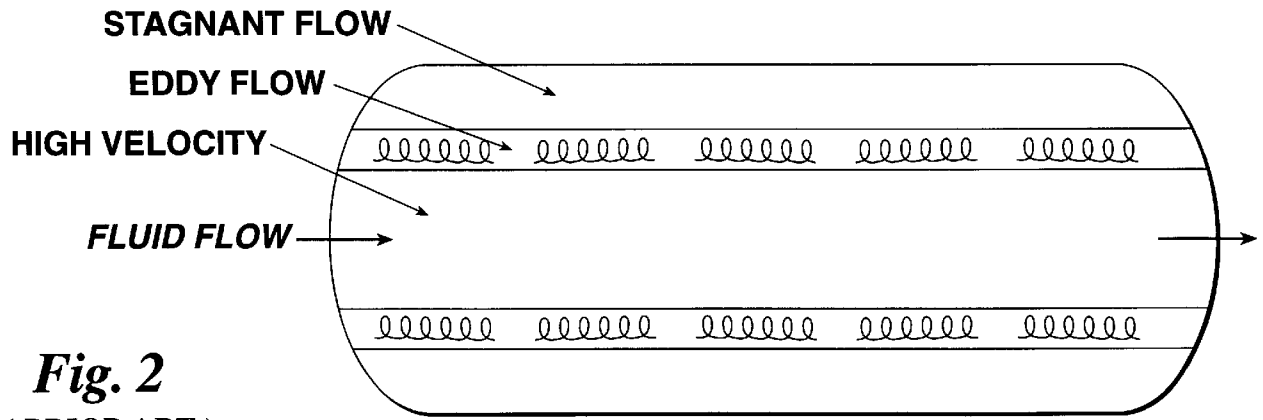
Fig. 2 ( PRIOR ART )
FIG. 2 is a horizontal cross-sectional diagram illustrating the typical flow pattern of fluid in a prior art single passage vessel.
Figure 3:
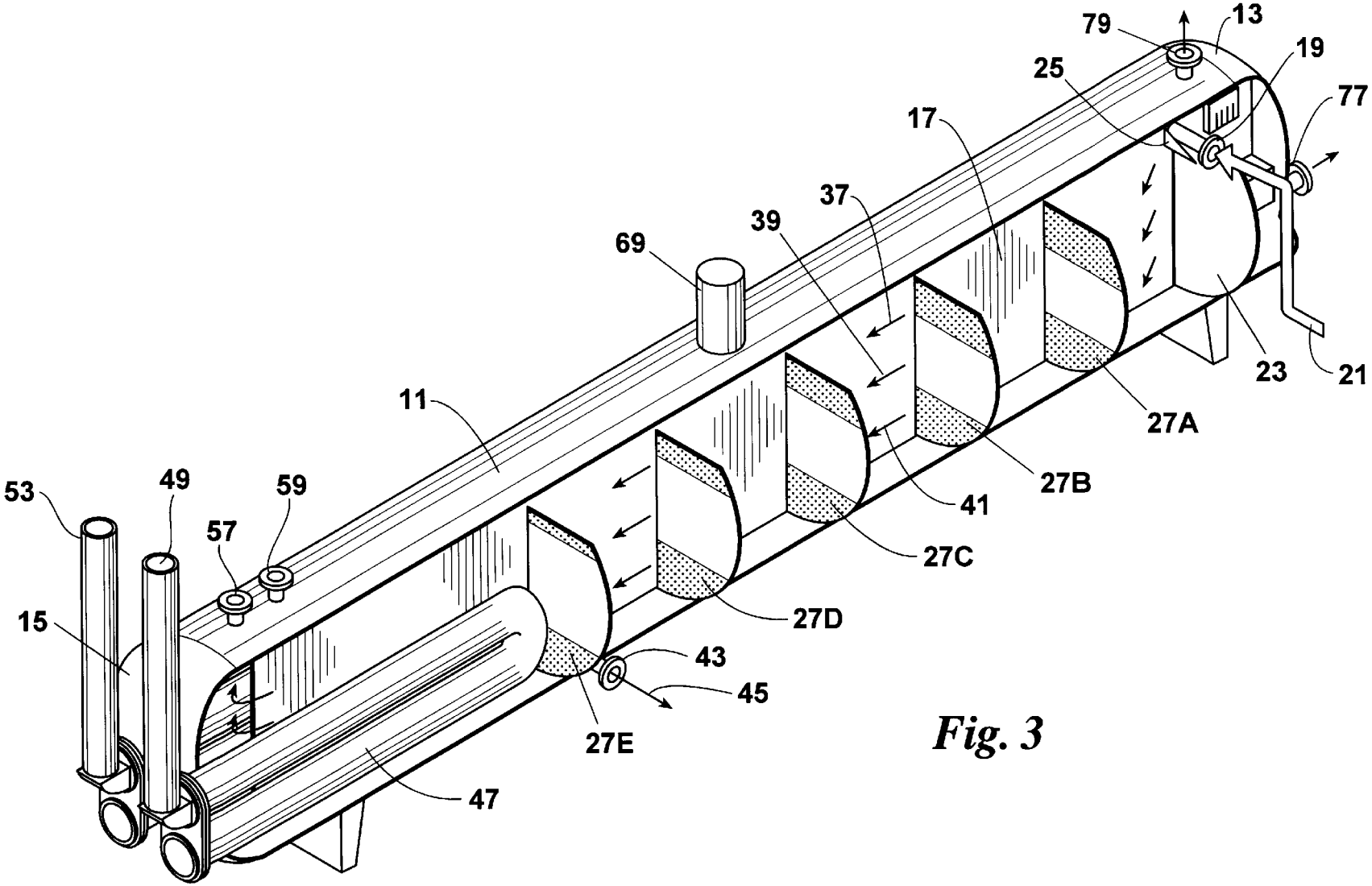
FIG. 3 is an inlet side perspective view with parts broken away of a preferred embodiment of the desalter of the present invention.
Figure 4:
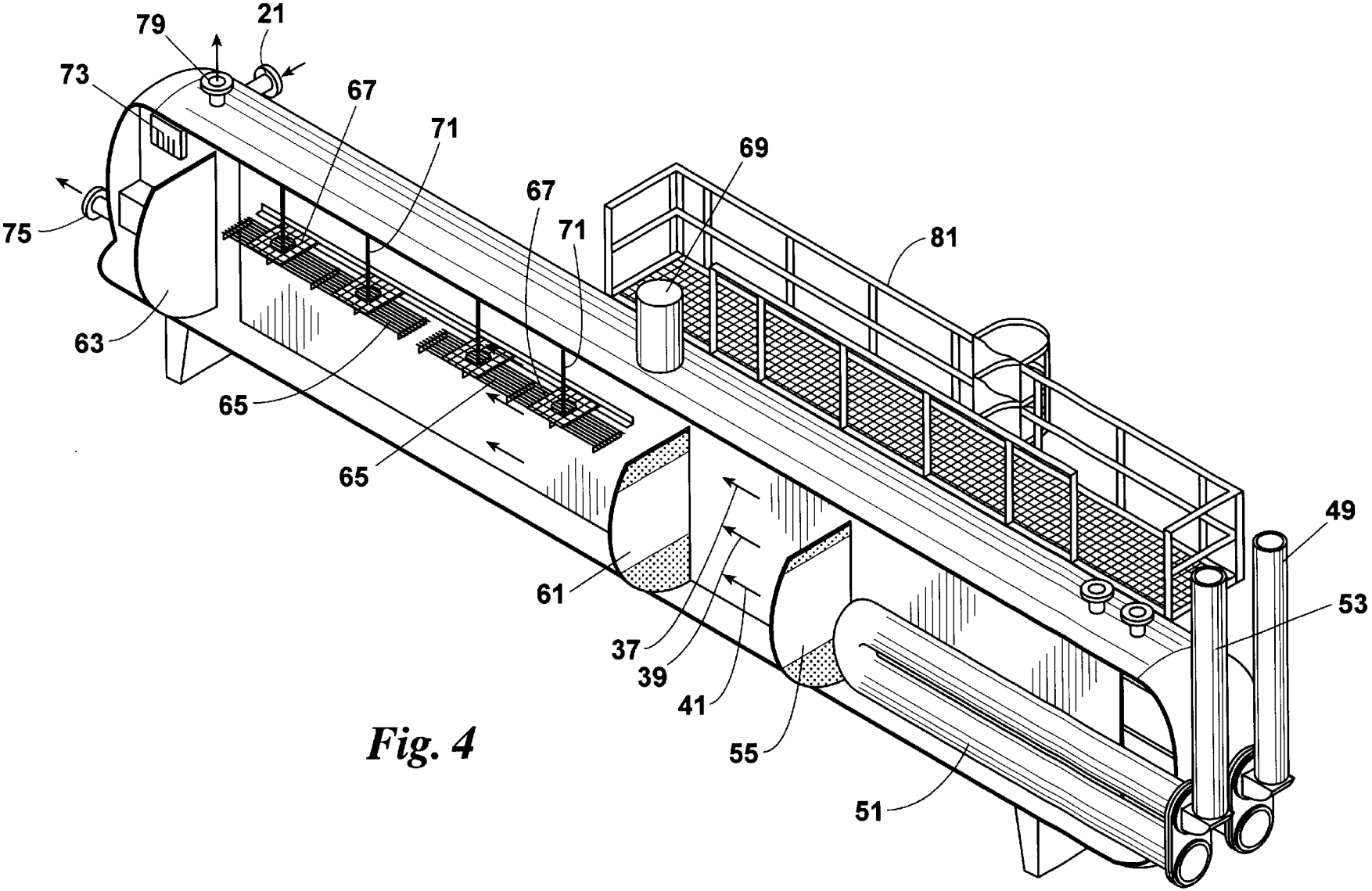
FIG. 4 is an outlet side perspective view with parts broken away of the desalter of FIG. 3.
Figure 5:
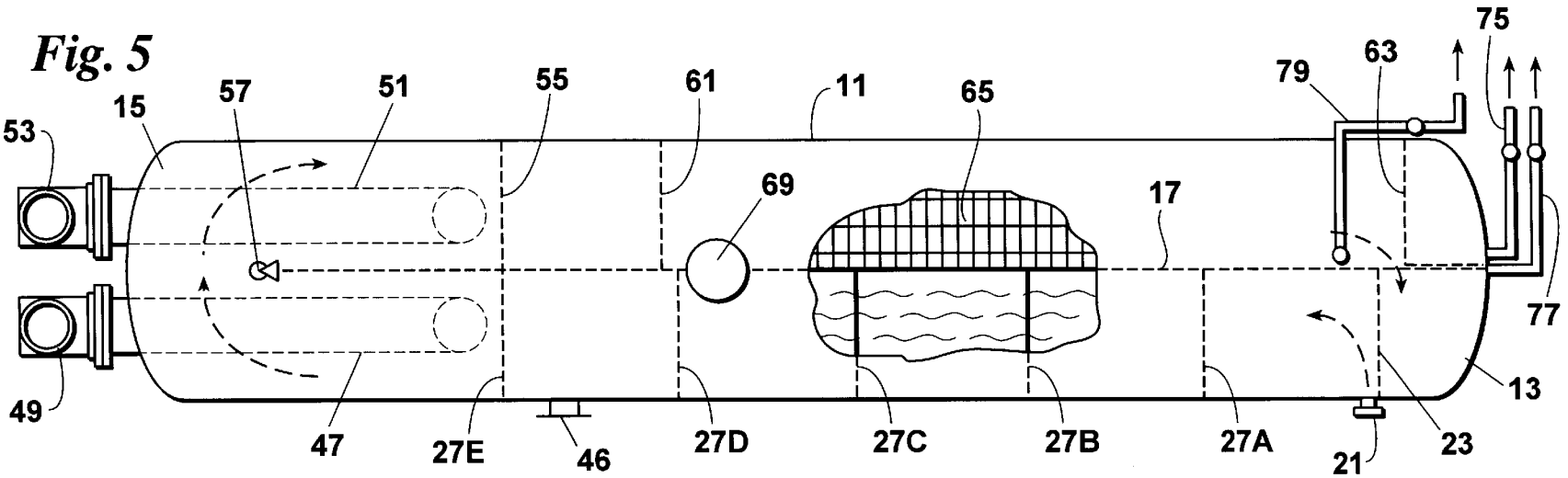
FIG. 5 is a top plan view of the desalter of FIGS. 3 and 4 illustrating the flow pattern through the desalter.
Figure 6:
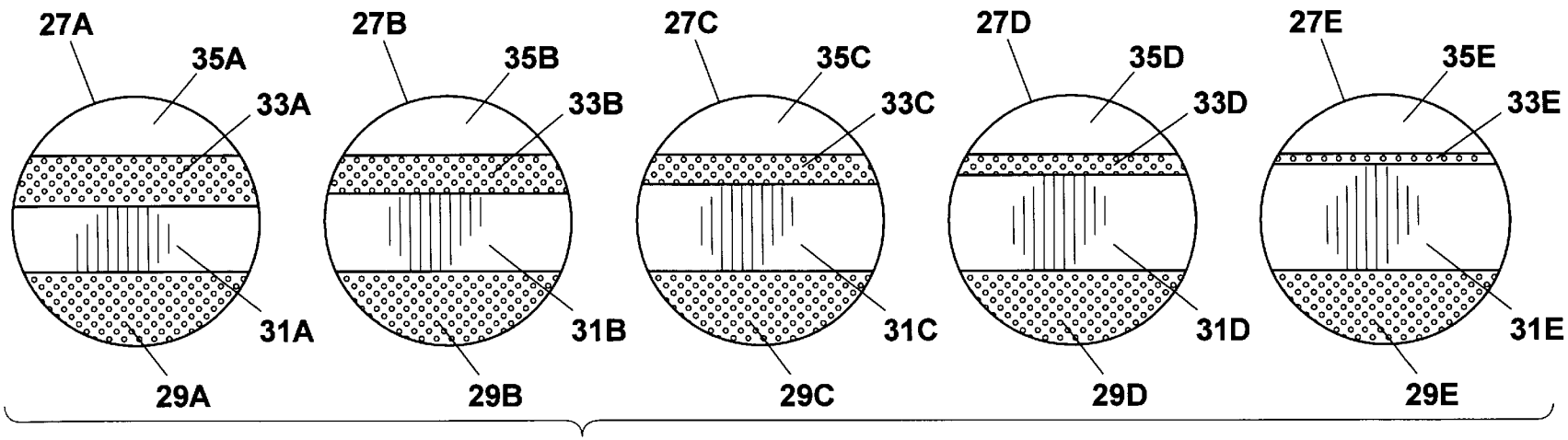
FIG. 6 is a sequence of front elevation views of consecutive baffles on the inlet side of the desalter of FIGS. 3–5.

Looking at FIGS. 3, 4 and 5, a preferred embodiment of the desalter is illustrated. The desalter is a longitudinally horizontal pressure vessel essentially in the shape of a circular cylinder 11 having front and back end caps 13 and 15, respectively. The vessel is diametrically divided from its front cap 13 to a point proximate its back cap 15 by a vertical wall 17. An inlet 19 through the cylinder 11 proximate the front cap 13 admits the fluid mixture 21 of oil, an emulsion of oil globules encapsulated in saltwater casings, gas and/or free water into the vessel on one side of the vertical wall 17 at ambient temperature typically ranging from 70 to 120° F. Preferably, as best seen in FIG. 3, a solid baffle 23 separates the inlet 21 from the front cap 13. An angled baffle 25 in the path of fluid flow out of the inlet 19 deflects the fluid mixture downwardly in the vessel. The deflected fluid naturally tends by force of gravity to separate into tiers from top to bottom of gas, oil, the emulsion and free water. A plurality of vertically oriented baffles 27A are spaced at intervals on the inlet side of the vertical wall 17 downstream of the inlet 19. As can best be seen in FIG. 6, the baffles are divided along horizontal lines into a lowermost perforated zone 29, a lower central solid zone 31, an upper central perforated zone 33 and an uppermost open zone 35. Each horizontal line dividing the lower central solid zone 31 from the upper central perforated zone 33 of its baffle 27 is higher than the corresponding line of the preceding baffle 27 along the flow path from the inlet 19. The most upstream baffle 27A has the lowest solid zone 31A and the most downstream 27E has the highest solid zone 31E. Thus, as shown in FIG. 3, gas will flow in an upper path 37 through the uppermost open zones 35 of the baffles 27, oil will flow along a path 39 through the upper central perforated zones 33 of the baffles 27 and free water will flow on a path 41 through the lowermost perforated zones 29 of the baffles 27. The perforations in the lowermost perforated zones 29 also further strip salt water casings from oil globules mixed in the free water and help to clean the water by coalescing the oil. However, the lower central solid zones 31 of the baffles 29 block the flow of emulsion between the baffles 27. Since the height of the lower central solid portion 31 of each baffle 27 increases along the flow path of the vessel, the purity of the oil passed through the upper central perforated zones 33 is sequentially improved as the retention time of the less pure oil or emulsion in the vessel is increased. That is, the increased retention time afforded by the baffles 27 permits the water casings surrounding the oil globules to continue to rupture and release the water globules to the free water zone and the oil globules to the oil passing zone of the baffles 27. Typically, in a thirty foot long by ten foot diameter vessel, the water passing zone 29 extends for approximately one-third the height of the vessel with 3.3 feet, the gas passing zone 35 extends for approximately twenty percent or two feet of the height of the baffle 27 and the blocking zone 31 extends for approximately twenty-five to thirty-three percent or 2.5 to 3.3 feet of the height of the baffle 27. The height of the blocking zones 31A–E of sequential baffles 27A–E increases by approximately two inches per baffle.

An outlet 43 located just upstream of the last baffle 27E on the inlet side of the vertical wall 17 allows the free water passed through the baffles 27A–E to flow 45 out of the vessel. An interface controller 46 opens and closes a dump valve (not shown) to exhaust the free water from the vessel through the free water outlet 43. Downstream of the outlet 43, a first fire tube 47 extends between the baffle 27E downstream of the free water outlet 43 and the back end cap 15 and exhausts through a vertical pipe 49 mounted on the end cap 15. The tiers of fluid passed by the upstream baffles 27A–E flow past the fire tube 47 on one side of the wall 17 and then make a U-turn around the wall 17 toward the front cap 13 of the vessel. On the return side of the wall 17, a second fire tube 51 is vented by second exhaust pipe 53 extending upwardly from the back end cap 15. Another baffle 55 on the opposite side of the wall from the baffle 27 downstream of the free water outlet 43 completes the heating chamber of the vessel. The baffles 27E and 55 on opposite ends of the heating chamber are preferably made of heat retaining material so as to contain the heat in the heating chamber. Any heat exchanged between the upstream and downstream sides of the wall 17 is still used to break any emulsion that reaches the heating chamber. A safety relief valve 57 and rupture disk 59 in the upper wall of the fire chamber of the cylinder 11 protect against excessive pressure in the vessel. If the temperature of the fluid at the inlet 19 to the vessel is 100 degrees F. or greater, the fire tubes 47 and 51 need not be used and the heating chamber system can be left on pilot. The baffle 55 downstream of the fire tubes 47 and 51 is similar to the baffles 27A–E illustrated in FIG. 6 and further raises the blocking level to assure suitable retention time in the heating chamber.

Downstream of the downstream baffle 55 closing the heating chamber, a high voltage chamber begins at a perforated baffle 61 and ends at a solid baffle 63. The perforated baffle 61 is similar to the baffles 27A–E illustrated in FIG. 6 and further raises the level of the blocking zone above the level established by the heating chamber downstream baffle 55. A horizontal high voltage hot grid 65 and a plurality of horizontal grounded grid grates 67 are suspended in the high voltage chamber in spaced apart relationship at a level such that they are immersed in the emulsion tier of the fluid in the high voltage chamber. The grids 65 and 67 are connected to a high voltage transformer 69 mounted on the upper exterior of the vessel cylinder 11. Furthermore, the horizontal arrangement of the grids 65 and 67 through substantially the length of the high voltage chamber exposes the fluid to the high voltage considerably longer than a vertical grid arrangement will allow. The elevation and spacing of the grids 65 and 67 can be adjusted by repositioning either or both grids 65 and/or 67 on their supporting hangers 71. Since the free water has already been substantially removed from the vessel before the fluid enters the high voltage chamber, the fluid in the chamber has greater dielectric qualities and the grids 65 and 67 can be more closely oriented to each other than if the free water had not been removed. That is, while the salt water removed from the vessel at the outlet 43 upstream of the heating chamber is conductive, the distilled water and pure oil passed to the high voltage chamber are nonconductive. By decreasing the space between the grids 65 and 67, a higher current across the plates 65 and 67 will result. Conversely, increasing the space would reduce the current. Therefore, for higher volumes of water in the fluid, increasing the space between the grids 65 and 67 is desirable. While the current may be reduced, the flux applied to the fluid is the same regardless of the spacing, so the necessary stretching of the emulsion to rupture the salt water casings can still be achieved. An appropriate balance is required because if the emulsion is not sufficiently stretched, rupture of the salt water casings will not occur. However, if the globules are stretched too much, they will split into smaller emulsion globules rather than separate into oil globules and free water globules.

Looking at FIG. 5, it can be seen that the downstream high voltage baffle 63 is closer to the front end cap 13 of the vessel than the inlet baffle 23. Thus fluid can flow through a slot or aperture 73 in the vertical wall 17 before being released from the vessel. It is preferred that the lower edge of the slot 73 be slidably vertically adjustable to establish a desired spill over level to further permit control of the retention time of fluid in the vessel. That is, the higher the slot 73 is raised, the greater liquid retention time will be achieved because the liquid must attain the higher level. The separated fluid reaching the forward end cap 13 is vented from the vessel via an oil outlet line 75, a water outlet line 77 and a gas outlet line 79. A scaffold 81 provides access to the vessel.

Figure 7:
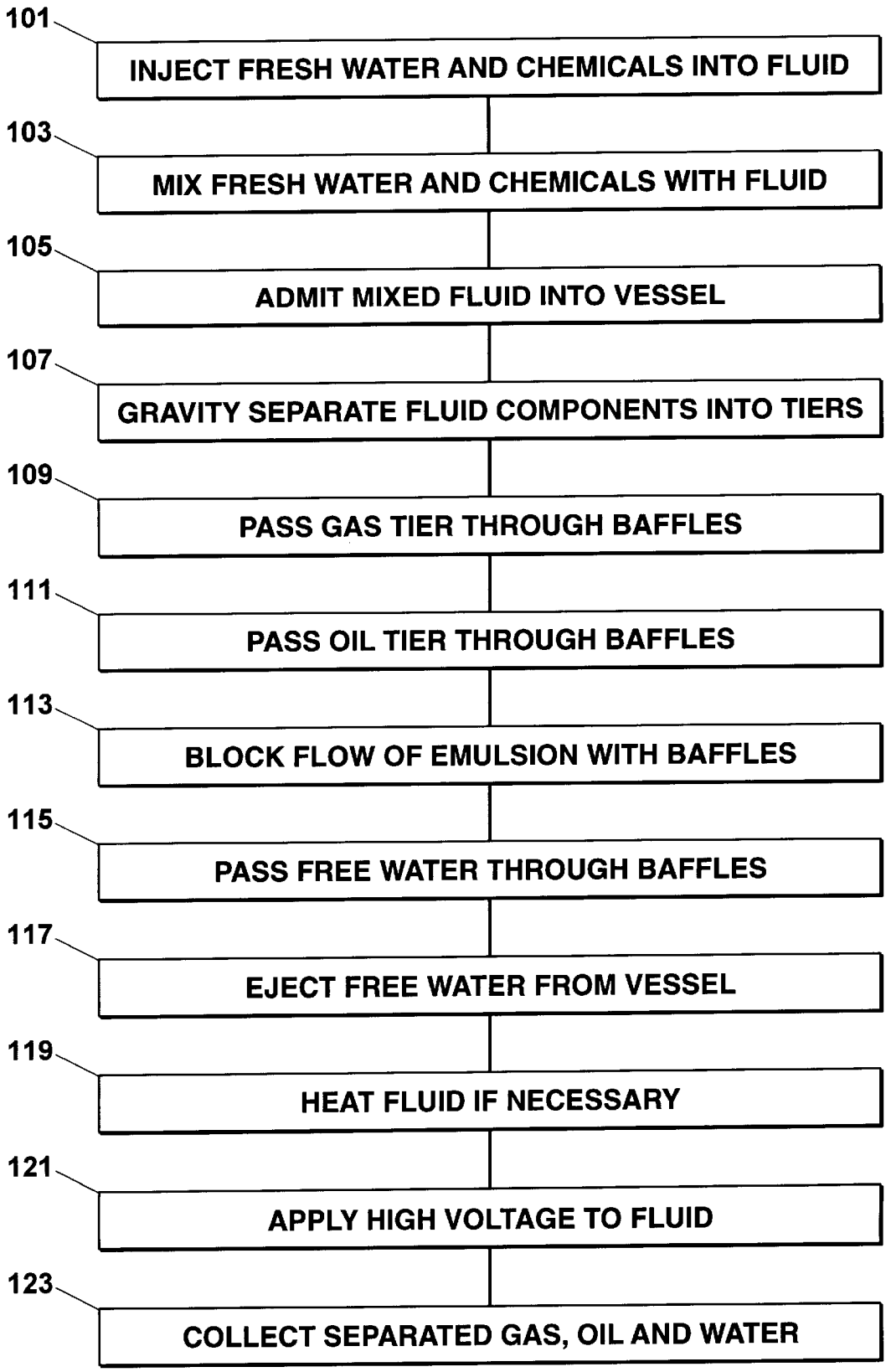
FIG. 7 is a block diagram illustrating the desalting method of the present invention.

Looking at FIGS. 5 and 7, the operation of the desalter can be understood. Fresh water and emulsion breaking chemicals are injected 101 into a fluid of gas, oil, emulsion of oil globules encapsulated in water casings and water. The injected water and/or chemicals are mixed 103 with the fluid to dissolve the salt. The fluid is admitted 105 into the longitudinally horizontal vessel. The gas, oil, emulsion and water are substantially separated 107 by gravity into tiers. The gas tier is passed 109 through the upper open portions of the baffles 27A–E to scrub liquids from the gas by gravity fallout. The oil is passed 111 through perforations in the upper central portions 33A–E of the baffles 27A–E to detrain gas entrained in the oil. The flow of emulsion is blocked 113 by the unperforated portions of the lower central solid portions 31A–E of the baffles 27A–E which are increasingly higher along the flow path so as to increase the retention time of the emulsion in the vessel and to allow breaking of the emulsion. The free water is passed 115 through the lowermost perforated zones 29A–E of the buffer 27A–E. Substantially all of the free water is then ejected 117 from the vessel downstream of the first series of baffles 27A–E. The passing 109, 111 and 115 and blocking 113 steps occur simultaneously. With the free water removed, the fluid is heated 119 to a temperature of approximately 100 to 120° F. if the fluid is not already at that temperature. After removing the free water or after heating the fluid, if necessary, alternating current at high voltage is applied to the emulsion using spaced apart horizontal grids 65 and 67 to further break down the emulsion. After the high voltage has been applied, the separated gas, oil and water are collected 123 in independent retrieval systems.

Depending on the application, the number, zone dimensions and perforation dimensions of the baffles may vary considerably. The lengths of the various chambers and operating temperatures and pressures may also be varied.

Thus, it is apparent that there has been provided, in accordance with the invention, a desalter and method of desalting oil that fully satisfies the objects, aims and advantages set forth above. While the invention has been described in conjunction with a specific embodiment and method thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A desalter for removing water, salt and gas from a fluid mixture of oil, an emulsion of oil globules encapsulated in salt water casings, gas and/or free water comprising:

a longitudinally horizontal pressure vessel having an inlet for admitting the fluid therein and a plurality of outlets for separately discharging gas, free water and oil therefrom; and a plurality of vertical baffles disposed at intervals between said inlet and said outlets, said baffles being divided along horizontal lines into a lowermost perforated zone for passing free water, a lower central zone for blocking passage of the emulsion, an upper central perforated zone for stripping the salt water casing from the oil globules and for passing oil and an uppermost open zone for passing gas, said line dividing said lower central and upper central zones of each said baffle being higher than a corresponding said line of each preceding baffle in a flow path extending from said inlet to said outlets.

2. A desalter according to claim 1 further comprising a longitudinal vertical wall splitting said vessel, said flow path extending on one side of said wall from said inlet at a first end of said vessel through a turn at a second end of said vessel and back on another side of said wall to said outlets at said first end of said vessel.

3. A desalter according to claim 2 further comprising means disposed in said vessel proximate said second end thereof for heating the fluid to approximately 100 to 120° F.

4. A desalter according to claim 3, said means for heating comprising two sets of fire tubes, one set disposed on either side of said wall.

5. A desalter according to claim 4, said fire tubes being disposed being two of said plurality of baffles along said flow path, said two baffles being of heat retaining material.

6. A desalter according to claim 3 further comprising means disposed at a point along said flow path upstream of said heating means for removing free water from said vessel.

7. A desalter according to claim 6 further comprising an upper horizontal grounded grid, a lower horizontal high voltage grid and an alternating current source connected to said grids, said grids being disposed between two of said plurality of baffles downstream of said heating means and spaced for immersion in the emulsion blocked therebetween.

8. A desalter according to claim 2 further comprising an upper horizontal grounded grid, a lower horizontal high voltage grid and an alternating current source connected to said grids, said grids being disposed between two of said plurality of baffles and spaced for immersion in the emulsion blocked therebetween.

9. A desalter according to claim 8 further comprising means disposed in said fluid path proximate said outlets for adjusting a retention time of oil in said vessel.

10. A desalter according to claim 9, said adjusting means comprising a baffle having a slot therethrough, said slot having a vertically slidable lower perimeter.

11. A method of removing water, salt and gas from a fluid containing gas, oil, an emulsion of oil globules encapsulated in water casings and water comprising the steps of:

admitting the fluid into a longitudinally horizontal vessel having spaced apart vertical baffles along a flow path therein;

allowing the gas, oil, emulsion and water to be substantially separated by gravity into tiers;

passing the gas through open upper portions of the baffles to scrub liquids by gravity fall out therefrom;

passing the oil through perforations in the baffles to detrain gas entrained in the oil;

blocking the flow of emulsion with unperforated portions of the baffles which are increasingly higher along said flow path to increase the retention time of the emulsion in the vessel and to allow breaking of the emulsion; and collecting the gas, oil and water in separate retrieval systems.

12. A method according to claim 11 further comprising the steps of:

injecting fresh water into the fluid; and mixing the injected water with the fluid to dissolve the salt before admitting the fluid into the vessel.

13. A method according to claim 11 further comprising the steps of:

injecting fresh water and emulsion breaking chemical into the fluid; and mixing the injected water and chemical with the fluid to dissolve the salt before admitting the fluid into the vessel.

14. A method according to claim 11 further comprising the step of heating the fluid downstream of at least two of said plurality of baffles to a temperature of approximately 100° F. to 120° F.

15. A method according to claim 14 further comprising the step of ejecting substantially all the free water from the vessel prior to heating the fluid.

16. A method according to claim 15 further comprising the step of applying alternating current at high voltage to the heated emulsion using spaced-apart horizontal grids to further break down the emulsion.

* * * * *